US005644987A

United States Patent [19]

Eltgen

[11] Patent Number: 5,644,987

[45] Date of Patent: Jul. 8, 1997

[54] PROCESS AND APPARATUS FOR PRINTING USING A MAGNETIC TONER WHICH IS ELECTROSTATICALLY CHARGED

[75] Inventor: Jean-Jacques Eltgen, Danjoutin, France

[73] Assignee: Nipson, Belfort, France

[21] Appl. No.: 262,500

[22] Filed: Jun. 20, 1994

[30] Foreign Application Priority Data

Jun. 23, 1993 [FR] France ..... 93 07608

[51] Int. Cl.[6] ..... B41N 1/04; G03G 19/00; G03G 13/28

[52] U.S. Cl. ..... 101/478; 101/211; 101/487; 101/DIG. 37; 101/DIG. 48; 346/74.2; 347/112; 399/3; 430/39

[58] Field of Search ..... 101/211, 467, 101/483, 487, 488, 489, 478, DIG. 37, DIG. 48; 346/74.2, 74.4, 74.5, 74.7; 347/112, 154; 430/39; 355/272; 399/3, 313, 318

[56] References Cited

U.S. PATENT DOCUMENTS

| | | | |
|---|---|---|---|
| 3,804,511 | 4/1974 | Rait et al. | 346/74.2 |
| 4,122,456 | 10/1978 | Berkowitz et al. | 346/74.5 |
| 4,395,946 | 8/1983 | Price | 101/211 |
| 4,636,449 | 1/1987 | Gorondy | 430/39 |
| 5,016,062 | 5/1991 | Rapkin | 347/154 |
| 5,129,321 | 7/1992 | Fadner | 101/467 |
| 5,140,370 | 8/1992 | Kasai et al. | 346/74.2 |
| 5,351,617 | 10/1994 | Williams et al. | 101/467 |

FOREIGN PATENT DOCUMENTS

| | | | |
|---|---|---|---|
| 0029877 | 6/1981 | European Pat. Off. . | |
| 0097954 | 1/1984 | European Pat. Off. . | |
| 512549 | 11/1992 | European Pat. Off. . | |
| 58754 | 3/1986 | Japan | 346/74.7 |
| 135248 | 6/1988 | Japan | 101/136 |

OTHER PUBLICATIONS

Patent Abstracts of Japan, vol. 7, No. 262 (P–238) (1407) Nov. 22, 1983 & JP–A–58 145 970 (Konishiroku Shashin Kogyo K.K.) 31 Aug. 1983.

Patent Abstracts of Japan, vol. 10, No. 19 (P–423) (2076) Jan. 24, 1986 & JP–A–60 172 065 (Fuji Xerox K.K.) Sep. 5, 1985.

Patent Abstracts of Japan, vol. 6, No. 82 (P–116) (960) May 20, 1982 & JP–A–57 019 761 (Ricoh K.K.) Feb. 2, 1982.

*Primary Examiner*—Stephen R. Funk

*Attorney, Agent, or Firm*—Kerkam, Stowell, Kondracki & Clarke, P.C.; Edward J. Kondracki

[57] ABSTRACT

A process and apparatus for printing with a press at least one image by transfer of an electrostatic colorant vehicle between an intermediate transfer element and a printing carrier, including the steps of making the intermediate transfer element in the press by magnetically developing zones on a substrate, depositing a magnetic, insulating, and hardenable material on the substrate to constitute the zones, hardening the hardenable material, subjecting the hardenable material to an electrostatic charge in order to lend the zones an affinity for the colorant vehicle, and transferring the colorant vehicle to the printing carrier by directly contacting the intermediate transfer element to the printing carrier.

26 Claims, 3 Drawing Sheets

STEP 1

STEP 2

STEP 3

STEP 4

PROCESS AND APPARATUS FOR PRINTING USING A MAGNETIC TONER WHICH IS ELECTROSTATICALLY CHARGED

BACKGROUND OF THE INVENTION

1. Field of the Invention

The invention relates to a novel printing process and to the press for implementing this process.

2. Description of the Related Art

The process of the invention is a hybrid process, combining in some way the techniques and advantages of current magnetography with the techniques of magnetolithography as they have been described in French Patent Application 93 00301, filed on Jan. 14, 1993 and assigned to Nipson, entitled "Procédé d'impression et presse pour la mise en oeuvre" [Printing Process and Press for Implementing It], and the techniques of electrostatography.

U.S. Pat. No. 5,129,321 assigned to Rockwell International Corporation discloses a lithographic printing system that makes it possible to dispense with the use of an engraved plate and hence with the positioning and adjustment thereof, but it has the disadvantage of not being perfectly suitable to high press runs.

In this lithographic printing system, in order to print with the aid of a conventional (oleaginous) ink, the invention in fact consists of replacing the assembly constituted by the engraved plate and the plate cylinder with a simple cylinder on whose periphery a layer forming a substrate of a powdered oleophobic material is deposited, each time a new motif is to be printed; with the aid of a hardenable oleophilic material, an image corresponding to the motifs to be printed is deposited on this uniform layer. The intermediate transfer element is accordingly constituted by the substrate of oleophobic material and the zones of oleophilic material carried by this layer.

Preferably, the oleophobic material is magnetic, and the cylinder is magnetizable, so that the layer of this material will be held on the periphery of the cylinder, magnetizing it.

Depositing the oleophilic material in a configuration corresponding to the motifs to be printed is done with the aid of an electronic, electromechanical or electromagnetic transfer device, for transferring data representative of the motifs to be placed on the layer of oleophobic material, the data being contained in an electronic memory. This data is utilized so that the transfer device deposits the oleophilic material solely at the locations necessary on the oleophobic layer. In an implementation described in the aforenoted patent, the oleophilic material used is a magnetic fusible material; its deposit on the substrate of oleophobic material is done by magnetodeposition on the cylinder, in the way in which magnetic toner is deposited in magnetographic printers. To that end, magnetic heads are disposed in proximity with the cylinder, and they make it possible to create on the substrate zones whose magnetization makes it possible to attract the particles of oleophilic material.

After its deposition, the oleophilic material is fused, which enables it to harden, so as on the one hand to prevent the motifs from deforming and on the other to lend it a certain cohesion with the substrate of oleophobic material, with the particles of oleophilic material attaching to the particles of oleophobic material. To that end, the system described in the aforementioned patent further includes, in proximity with the periphery of the cylinder, a fuser device for fixing the oleophilic material.

Printing is done as on a conventional press: the cylinder, after having been coated with the layer forming the substrate and the motifs, is set into rotation, then moistened and inked, in such a way that the ink spreads over the motifs and the moistening product spreads over the oleophobic zones, and then the ink is transferred to the printing carrier (paper or other material) by way of a blanket.

Once the desired run of an image is reached, the cylinder is demagnetized, so that the layer forming the substrate spontaneously detaches from the cylinder, bringing with it the hardened motifs of oleophilic material that it carries. If printing of another image is desired, then a new substrate is made, on which new motifs are deposited and then hardened. Both the making up of the motifs corresponding to an image and their removal are accordingly very fast and less expensive than with conventional presses.

This apparatus is capable of polychrome printing, to the extent that the positioning of the motifs is done automatically, by an electronic device.

However, it requires the deposit of two types of materials: that making up the substrate, and that making up the motifs. Depositing the substrate has the function of enabling easy later removal of the oleophilic motifs by forced detachment from the substrate, and of preventing the ink from being deposited on the portions of the cylinder that are not provided with oleophilic material.

In addition, it is not actually suitable for high press runs, because the substrate has a tendency to spontaneous detachment, at least in some regions, when the carrier cylinder rotates during the printing phases, since it is held merely magnetically. Accordingly, the outgoing copies have to be checked, and sometimes the image (substrate and motifs) on the periphery of the cylinder have to be reconstituted during the run.

U.S. Pat. No. 3,804,511 assigned to Pelorex Corporation also discloses a printing apparatus and process for an image for transfer of at least one colorant vehicle between an intermediate transfer element and a printing carrier, including at least one phase of automatically making the intermediate transfer element by developing zones on the intermediate element, each zone having a different affinity for the colorant vehicle. The different affinity of the zones is obtained by developing an electrostatic image of the graphical information by exposing an endless strip whose upper layer is made up of zinc oxide. Particles of magnetic toner are then applied to that surface and adhere as a function of the electrostatic image developed on the layer of zinc oxide. Portions of this surface are magnetized to form a magnetic image corresponding to the electrostatic image. Next, the toner particles are transferred by pressure to a copying medium, such as paper, while the magnetic image is preserved on the surface of the strip. New magnetic particles can then be applied to the magnetic image to produce additional copies.

Such an apparatus has the disadvantage of using a strip or tape of zinc oxide, which is a first generation photoconductor whose service life is very short.

On the other hand, if such a tape is not to succumb to fatigue, the cycling time between the exposure of an image and the resetting to zero of the strip to change the image must be quite long, that is, on the order of one second. This accordingly requires tapes of very great length and involves high expense for the equipment.

SUMMARY OF THE INVENTION

Accordingly, the primary object of the present invention is to overcome the disadvantages of the prior art by proposing a printing process which is low in cost while allowing constant quality and monochrome and polychrome lithographic printing capabilities, regardless of the press run planned, without requiring engraving of a plate, without recourse to materials that require oleophilic or oleophobic qualities in order to solve the problems of moistening, and without requiring a blanket.

This object is attained in that the process for printing at least one image, with a predetermined press run, using a press, by transfer of a colorant vehicle between an intermediate transfer element obtained by magnetic imaging and a printing carrier, including at least: a phase of automatically making the intermediate transfer element in the press by developing zones on a substrate, each zone having a different affinity for the colorant vehicle, certain of which zones correspond to the image to be printed, is characterized in that a magnetic, insulating and hardenable material is fixed to the substrate to constitute these zones with different affinities;

the magnetic insulating and hardenable material is hardened and subjected to an electrostatic charge by any device capable of surface charging in order to lend the zones representing the image the affinity for the colorant vehicle;

the colorant vehicle having electrostatic properties is deposited on the electrostatically charged portions of the hardened material, and finally the transfer of the colorant vehicle to the printing carrier is done by direct contact with the intermediate transfer element.

In another feature, the process includes a step of cleaning the transfer element by removal of the hardenable material when a new image is to be printed.

In another feature, the colorant vehicle is charged beforehand with electrostatic charges whose polarity is opposite the charge of the hardenable material.

Another object is to propose a press making it possible to implement the process of the invention.

This object is attained in that the press, including means for depositing a material at predetermined locations representative of an image on an endless strip carried by rollers enabling it to be set into motion, is characterized in that the endless strip is metallic, the material deposited is hardenable, and the press includes at least one station for electrostatically charging the hardened material and one station that furnishes a colorant vehicle having electrostatic properties for adhesion to the material after its hardening in order to constitute there the motifs to be transferred to the printing carrier.

In another feature, the press includes means for removal and cleaning of the hardened material.

In another feature, the press includes means for electrostatically charging the hardened material with a charge of given polarity.

In another feature, the electrostatic charge of the hardened material is obtained by a corona discharge device.

In another feature, the press includes means for charging the colorant vehicle with a polarity opposite that of the hardened material.

In another feature, the charge of the colorant vehicle is triboelectric, and the press, in the means for furnishing the colorant vehicle, includes a device that assures the brazing of the colorant vehicle in such a way as to cause the charging of the particles by friction.

BRIEF DESCRIPTION OF THE DRAWINGS

Further characteristics and advantages of the invention will become apparent from reading the description of embodiments of the invention which are given for illustration but are not limiting, in conjunction with FIGS. 1–3, in which.

DETAILED DESCRIPTION OF THE PREFERRED EMBODIMENT

Figure 1:
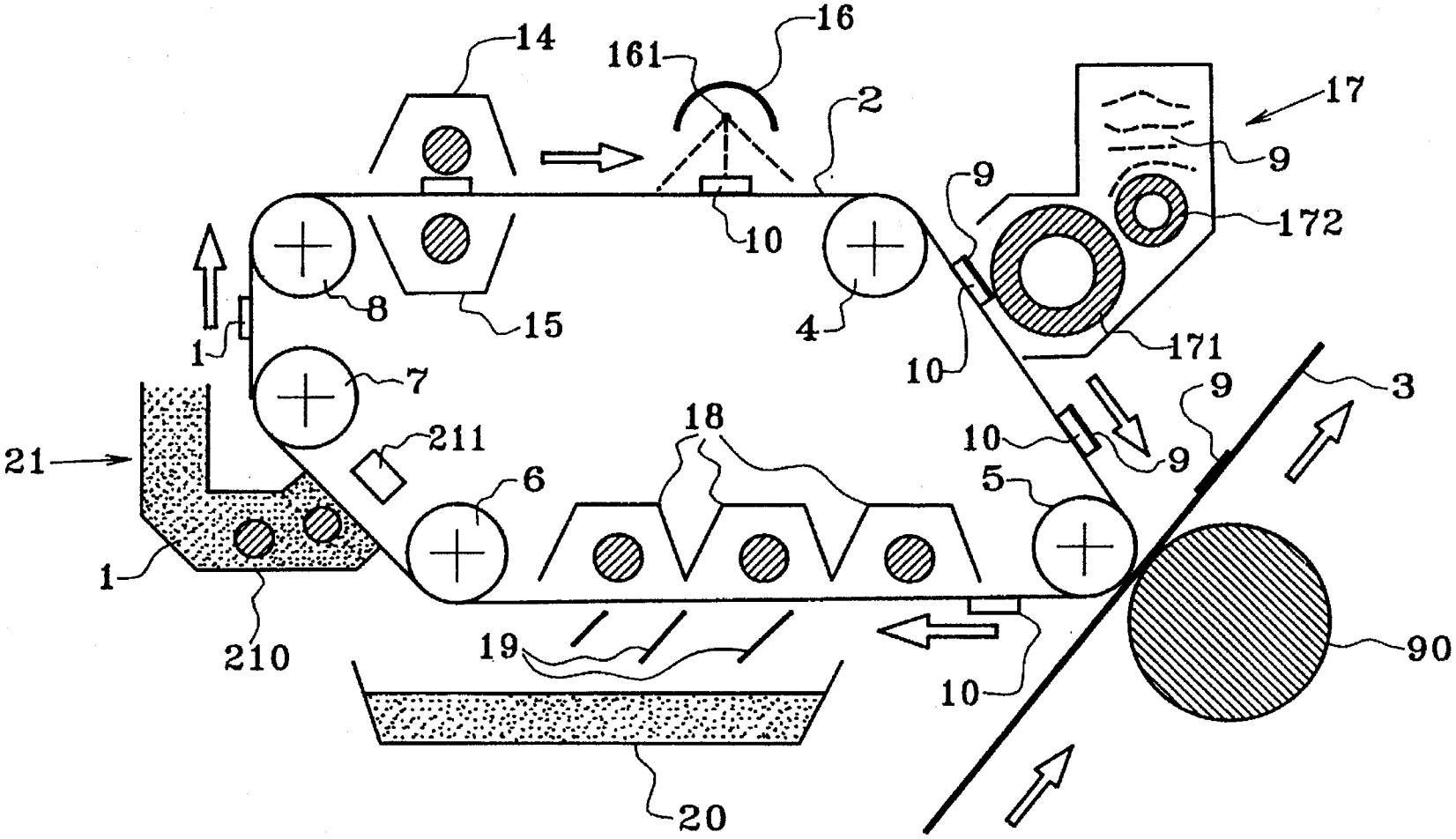
FIG. 1 shows a first embodiment of a press enabling monochrome printing by the process of the invention.

The press shown in FIG. 1 enables the deposition of a fusible material 1 to an endless metal strip 2, in order to constitute the intermediate element that carries motifs corresponding to an image to be printed on a printing carrier 3, such as continuously fed paper. The endless strip, carried by carrier rollers 4, 5, 6, 7, 8, is in contact with the printing carrier, such as paper 3, with the aid of a pressure roller 90.

In the example shown, the fusible or meltable material 1 is powdered and magnetic and is contained in a reservoir 210 before its deposition onto the endless strip 2. A device 21 for magnetically transferring the fusible material 1 from the reservoir to the strip is provided and allows the hardenable material 1 to be used as a magnetic material that can be hardened by fusion, polymerization, or some other method. The substrate formed by the endless strip is a material that itself is magnetizable. A device 21 for placement of the material 1 at appropriate locations on the strip 2 is composed on the one hand of a reservoir 210 of material provided with an outlet opening and placed toward the face of the strip 2 that is in contact with the printing carrier 3, and on the other hand an excitation device 211 with magnetic heads, placed on the other side of the strip, or in other words inside the space defined by the endless strip. This excitation device makes it possible to excite predetermined points of the strip selectively in order to magnetize it and attract the material 1 contained in a reservoir to these points, so as to form zones there where an affinity for the colorant vehicle (ink) can be developed.

The set (211) of magnetic heads is displaceable relative to the strip in order to compensate for the spacing between the heads and to constitute motifs of high printing quality on the strip.

It is suitable for the dimensions of the endless strip 2 to enable reproduction there of the largest image intended to be printed with the press; that is, for example, the developed length and the width of the strip 2 should be at least equal to the respective length and width of this image.

The material 1, after having been transferred to the metal strip 2, is firmly fixed to it. As has already been indicated, this operation makes it possible to prevent detachment of the motifs during printing.

In the implementation mode illustrated by this FIG. 1, this fixation is done by heating the material and then allowing it to cool. To accomplish this, at least one heating device 14 is provided in proximity with the strip 2, taking into account the direction of travel (illustrated by arrows) thereof, so that the material will be fixed immediately after having been deposited, and acts on the entire width of the strip and on a small portion of its length.

Preferably, this device 14 is disposed facing the surface of the strip that receives the fusible material, so that its action will be as effective as possible. However, as this figure illustrates, in order for the heating to be even more effective and rapid, it is possible to contemplate disposing at least one other heating device 15, facing the first device 14, and facing the surface of the strip opposite the surface that receives the material. It is understood that because of the low thermal inertia of the strip, a heated portion thereof will cool as soon as it leaves the zone, of slight length, heated by the means 14, 15, so that the hardening is very rapid. In this way, the material adheres to the substrate (strip) by bonding forces, and magnetic forces are involved only at the time of development of the magnetic image.

In a variant, the material used is hardenable and fixable by polymerization, either natural or forced, for example by exposing it to ultraviolet radiation. In that case, the device 14, or in other words the device located facing the surface of the strip that receives the fusible material 1, will be replaced by a suitable source of radiation. No source whatever corresponding to the device 15 is provided facing it, since the radiation will be stopped by the strip 2.

It is understood that the magnetic transfer device 211 and the heating devices 14, 15 are not put into operation unless necessary, for constituting zones representing the image on the thin strip 2.

The hardened material 1 magnetically joined solidly to the strip 2 is moved to a corona discharge station 16, where a corona wire 161 electrostatically charges this material 1 with an electrostatic charge 10. As the material 1, a magnetographic toner can be used, which because of the magnetic ingredients it contains has a low colorability potential but because of the polymerizable materials enabling its hardening is a very good insulator (resistivity between 1012 and 1014 ohms per centimeter), which enables it to charge electrostatically without difficulty when the metal strip 2, which itself is conductive, retains no electrostatic charge whatever. At the outlet to this station, there is accordingly a substrate 2 regionally coated with zones covered with a hardened material of differing affinity with the colorant vehicle that is deposited on it in the inking station 17. This colorant vehicle 9 will advantageously be constituted by an electrostatic toner with a good colorability potential. This toner 9 will be deposited on the zones having affinities, or in other words on the zones coated with the electrostatically charged hardened material. By way of example, the inking station 17 will include two rollers 171, 172 assuring internal fusing of the toner made up in large part of polymers so as to charge this toner by triboelectricity, in the case of a solid electrostatic toner used in conjunction with a carrier, as is known in the prior art in electrophotography. In a variant, liquid electrostatic toners can be used, the toner being made up of fine colorant particles and the carrier then being made up of a liquid having the required dielectric characteristics, as is also known in the prior art. The charges thus developed in the toner are preferably of opposite polarity to those developed on the magnetic hardened material 1. In contact with the strip of the printing carrier 3, the electrostatic toner 9 is transferred to the printing carrier 3, and only the hardened magnetic material 1 remains on the substrate 2.

Finally, the press includes a device for removing material, put into action when the press run of an image has been reached, to enable detaching the intermediate transfer device without deteriorating the substrate made up of the surface of the thin strip.

In the case of the press shown in FIG. 1, arranged to function with a fusible or meltable material 1, the removal device includes means 18 for remelting the material, such as heating devices, cleaning means 19, such as scrapers or squeegees, and optionally a reservoir 20 for collecting the material. The remelting means 18 and cleaning means 19 are disposed relative to one another and to the strip such that the zones that have to be cleaned are heated, so that the material 1 will be at least partly remelted, before undergoing the action of the cleaning means 19, and so that the remelting will continue when the cleaning means are active.

The embodiment of FIG. 1 makes it possible to meet these constraints: The remelting means 18 are disposed facing the surface of the strip opposite the surface that receives the material, and the cleaning means 19 are on the side of the surface that carries the material. The latter means are face to face with only a portion of the remelting means, so that there is a zone in the press where the zones of the strip that are to be cleaned undergo the simultaneous action of the remelting means 18 and cleaning means 19.

Preferably, the removal device is disposed in such a way that the action of the cleaning means 19 is facilitated by natural gravity. FIG. 1 shows how this device should be placed so that this action will be optimal. The cleaning means are positioned in such a way as to act on a horizontal portion of the strip, with the surface to be cleaned facing the ground. Hence the material after having been remelted has a tendency to drop spontaneously by gravity into the collection reservoir 20 which is then located below.

It is understood that other arrangements of the removal device are possible to enable natural gravity to facilitate the cleaning. It suffices for the removal device to act upon a portion of the strip disposed in a more or less pronounced slope oriented toward the ground.

The low thermal inertia of the metal strip has the consequence that as soon as a portion is no longer subjected to the radiation of the remelting device, it cools very rapidly, enabling the quasi-immediate constitution of a new intermediate transfer element.

As has been mentioned above, instead of accomplishing a thermal attack to remelt the material 1 in order to clean the metal strip 2 with a view to preparing a new intermediate transfer element, it is possible to effect a chemical attack, on the condition that the agents chosen do not attack the metal strip. It will be appreciated that this operation is much trickier and that one may prefer thermal attack. The endless strip is then preferable in the case of a chemical attack, because it is more easily ready for cleaning. In addition, chemical attack generally causes the production of heat, and the low thermal inertia of a strip then enables its rapid cooling after a cleaning operation employing such an attack, and hence enables the immediate constitution of a new transfer element.

In a variant embodiment of this method, the cleaning and collection means 19 and 20 are present, but the remelting means are replaced with means 221 that enable projecting the chemical agent. These latter means are disposed in such a way that on the one hand the chemical attack of the material 1 is started before the material comes into contact with the cleaning means, to facilitate their action, and on the other so that their action will be completely effective.

The apparatus shown in FIG. 1 permits only monochrome printing, since it contains only a single press and/or inking station.

Figure 2:
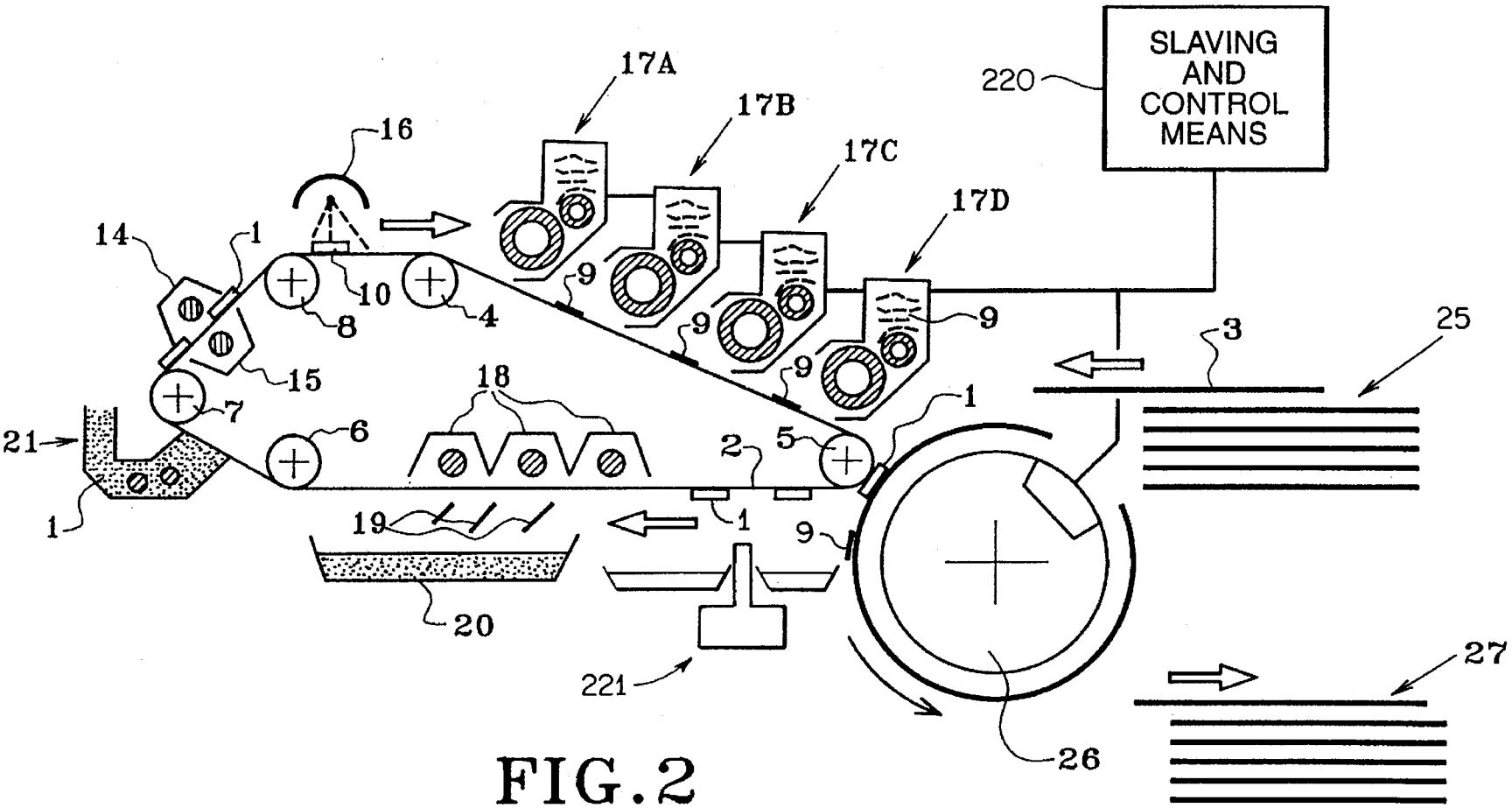
FIG. 2 shows another embodiment of a press enabling polychrome printing.
Figure 3A:
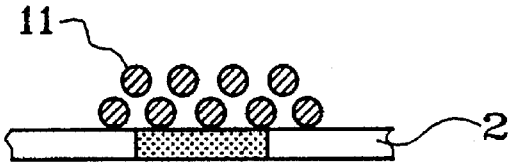
FIG. 3 illustrates the printing principle implemented in the process of the invention.
Figure 3B:
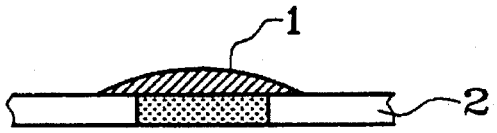
Figure 3C:
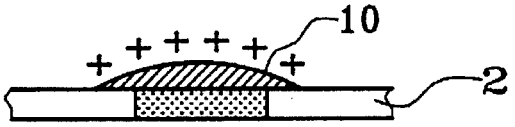
Figure 3D:
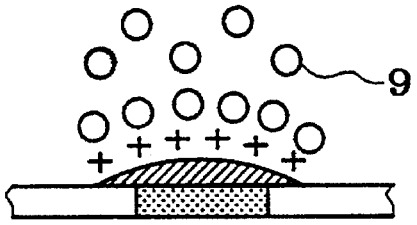

The apparatus of FIG. 2 enables polychrome printing one sheet at a time, or in other words printing of a carrier 3 that is in the form of independent sheets.

The apparatus of FIG. 2 enables sheet by sheet polychrome printing, for example using three colors (red, green and blue) in the case of additive synthesis, which is generally better suited to solid electrostatic toners, or four colors with three basic colors (yellow, cyan, magenta) and black in the case of subtractive synthesis, which is generally more suitable for liquid electrostatic toners. This apparatus is made up of four inking stations A, B, C, D placed one after the other and driven by a single slaving and control device 220.

In the example, the four inking stations (17A, 17B, 17C, 17D) are identical, and each corresponds to the station (17) described in conjunction with FIG. 1; that is, they each include one device for transferring a colorant vehicle 9, having electrostatic properties, to the strip 2 coated with a hardenable material 1. It is understood that this illustration is not limiting, and that the apparatus could contain presses corresponding to those described in conjunction with FIG. 1.

The first station 17A serves for instance to print yellow motifs, the second station 17B to print cyan motifs, the third station 17C to print magenta motifs, and the fourth station 17D to print black motifs. To do so, the sheets of paper 3 are put into contact with the transfer roller 26 of this press. The essential differences between the press of FIG. 2 and that of FIG. 1 in terms of paper feeding are as follows: The press is associated with a device 25, known per se and not shown in detail, for sheet feeding; a sheet carrying cylinder 26; and a device 27 for collecting printed sheets. The sheet carrying cylinder 26 is in contact with the periphery of the strip 2, such that the rotational movement of the strip is transmitted to the cylinder 26, making it possible to transfer the image to a sheet carried by the cylinder 26. It is understood that such a paper feeding device could be adapted to the press of FIG. 1 without changing the spirit of the invention.

The single control device drives the magnetic transfer device 21 so that not only will the motif be correctly positioned, but also the final image will be of irreproachable quality. It also drives the heating devices 14, 15, the electrostatic charge inking device 16, a single inking device 17A–17D at stations, and finally the devices 18, 19, 20 for removing the hardenable material.

In a preferred embodiment, the dimensions of the strip are such that it is possible, successively and adjacently, to constitute the basic motifs there which correspond to the separation of colors making it possible to constitute a given image. In fact, the developed length of the strip must be at least three times greater than the circumference of the sheet carrying cylinder, which determines the dimensions of the largest image that can be printed. In this case, slaving and control means 220 of the press enable selecting an inking station, for instance 17A, and activating it synchronously with the passage of the corresponding basic image. On the other hand, the slaving and control means 220 are such that the same sheet remains on the sheet carrying cylinder for at least three rotations, so that upon each rotation one of the basic images can be printed, so that the definitive image, which is a combination of at least three colors, appears on the sheet at the end of at least three rotations.

These preferred embodiments of the press, in which the length of the strip is a function of the circumference of the sheet carrying cylinder 26, make it possible for the same image to be printed in great numbers, which is often the case in conventional printing, by constituting the set of motifs (3 or 4) corresponding to each basic color of this image only a single time on the strip 2, and preserving this set in proper condition until the intended press run of this image is reached; as a result, the number of remelting and cleaning operations can be reduced, and high printing speeds can be attained.

If the length of the strip is not linked with the maximum size of the sheet to be printed but is less than three or four times this size, depending on whether the printing is in three or four colors, it is nevertheless possible to perform polychrome printing, but it is then necessary to clean the strip once or more times during the printing of each sheet and to constitute the various motifs, corresponding to the definitive image to be attained, separately, which results in a reduction in the printing speed when long press runs are to be attained.

In another variant, the polychrome document printing apparatus can be attained with the aid of n presses of the type of FIG. 1, each having a single station (17) for applying colorant vehicle, each station containing a different basic color from the others, and that it is arranged so that the printing carrier will pass successively past each of these presses.

The presses of the invention make it possible to obtain images of very good quality, with a print density comparable to that of lithographic presses.

FIG. 3, in more detail, shows the steps in the printing process of the invention by magnetoelectrostatography. This process includes a first step in which a zone of the strip subjected to a magnetic field attracts particles 11 of a powdered magnetographic toner. The second step shows the fusion of these powdered toner particles 11 to form a hardened substrate 1, which is held on the strip optionally by the remanent magnetism developed by it in the vicinity of the substrate, but above all by the bonding forces of the polymers on the metal strip. The third step represents the surface charging of the hardened substrate 1 by electrostatic charges upon passage through the corona station. At the surface of the melted substrate 1, which is made up of between 60 and 90% polymer, this operation develops electrostatic charges to form the charged substrate 10. The electrostatic charges induced by the corona tube 16 on the metal strip 2 dissipate in it, since this strip is conductive. Finally, fourth step represents the deposition on the charged substrate 10 of an electrostatic toner 9 charged with a polarity opposite that of the charge of the hardened substrate 10.

The process described attains the advantages of making a strong medium thanks to the fusion of magnetographic toner, while being free of the problems of a moistening solution or the presence of a blanket as in the process of magnetolithography. Furthermore, because it uses electrostatic toners, this process makes it possible to have better colorability than with magnetographic toners, because these electrostatic toners in principle give access to all colors.

In addition, the fundamental importance of the magnetographic developer is to reduce it to the role of a simple intermediary of the imaging, in order to enable the development of a magnetic image on a metal medium. Much shorter cycling times than in the prior art are thus obtained. In fact, magnetic toners were used to develop electrostatic images on photoconductive media, which in turn have very long cycling times requiring strips of very great length and hence result in expensive machines. Finally, the use of a relatively fragile and environmentally sensitive photoconducting medium would not enable either fusion nor remelting of the intermediate image element toner.

In addition, the step of remelting the magnetographic toner makes it possible to change the image on the strip easily.

Finally, between the various printing operations, the strip provided with the hardened substrate can be recharged by the corotron (corona tube) regularly upon each rotation (for each copy), without requiring a new imaging phase.

Accordingly, a system is achieved that can be used very flexibly, either with very long cycling times and electrostatic recharging during the cycling times, or with very short cycling times and with remelting prior to a new imaging phase.

I claim:

1. A process for printing at least one image, with a predetermined press run, using a press, by transfer of a colorant vehicle (9) between an intermediate transfer element and a printing carrier (3), including the steps of:

a. making the intermediate transfer element in the press by developing zones on a substrate (2) by magnetic imaging, each zone having a different affinity for the colorant vehicle, certain of which zones correspond to the image to be printed;

b. fixing an insulating and hardenable material (1) to the substrate (2) to constitute the zones with different affinities;

c. hardening and subjecting the insulating and hardenable material (1) to an electrostatic charge (10) by surface charging the material in order to lend the zones representing the image the affinity for the colorant vehicle (9);

d. depositing the colorant vehicle (9) having electrostatic properties on electrostatically charged zones of the hardened material (1), and transferring the colorant vehicle (9) to the printing carrier (3) by direct contact with the intermediate transfer element; and e. cleaning the substrate by removal of the hardenable material when a new image is to be printed.

2. The process of claim 1, further including charging the colorant vehicle (9) with electrostatic charges whose polarity is opposite the charge of the hardenable material (1).

3. The process of claim 1, wherein the hardenable material is magnetic, and further including constituting the intermediate transfer element by depositing onto the substrate (2) the magnetic hardenable material (1) with the aid of a magnetic transfer device (21) by picking up the material from a reservoir (210), and placing the material at predetermined regions of the substrate (2), in order to make an image corresponding to motifs to be printed, and further wherein said substrate is not removed from the press during operation of the press.

4. The process of claim 1, characterized in that the material (1) is hardenable by fusion, and the step of hardening the material (1) includes fusing the hardenable material.

5. The process of claim 1, characterized in that the material (1) is hardenable by polymerization, and the step of hardening the material (1) includes polymerizing the hardenable material.

6. The process of claim 1, characterized in that the hardenable material (1) is meltable, and the removal consists of melting said hardenable material (1) from the substrate (2), so that immediately after the removal, the substrate returns to the temperature that it had before the removal, thus enabling the making of a new transfer element without delay.

7. The process of claim 1, wherein the hardenable material (1) is chemically attackable, said process further including removing said hardenable material from the substrate (2) by a chemical attack, wherein said substrate is not affected by said chemical attack.

8. The process of claim 7, wherein said substrate is not removed during the printing process from the press and further including selecting said substrate (2) to have a low thermal inertia, so that an increase in temperature thereof due to the chemical attack is rapidly attenuated in order to enable making of a new intermediate transfer element after the removal of the material (1) from the substrate (2).

9. Process of claim 1, wherein immediately after the cleaning of the substrate, new zones are developed on the fly on the substrate by magnetic imaging, and new insulating and hardenable material is fixed to the substrate to constitute zones with different affinities, and further wherein steps c. through e. are thereafter repeated.

10. A printing press, including an endless strip (2) carried by rollers enabling said endless strip to be set into motion, means for depositing an insulating material at predetermined locations representative of an image on said endless strip (2), wherein the endless strip is metallic, the material deposited is hardenable, and the press includes means for hardening the hardenable material on said endless strip and at least one station (16) disposed on a way of the endless strip for electrostatically charging the hardened material (1) and at least one station (17) that furnishes a colorant vehicle (9) having electrostatic properties for adhesion to the material (1) after being hardened in order to make motifs to be transferred to a printing carrier (3).

11. The press of claim 10, wherein said at least one station (16) includes a corona discharge device.

12. The press of claim 10, further including means (171, 172) for charging the colorant vehicle (9) with a polarity opposite that of the hardened material (1).

13. The press of claim 12, wherein the means for charging the colorant vehicle (9) includes two rolls (171, 172) to charge the colorant vehicle by triboelectricity.

14. The press of claim 10, wherein the hardenable material (1) includes a polymer, the means for hardening said hardenable material on the endless strip comprising heating means (14, 15) facing the entire width and a small portion of the length of the endless strip, the hardenable material (1) being cooled and hardened automatically when not heated by the heating means (14, 15) because of the low thermal inertia of the endless strip (2).

15. The press of claim 14, wherein the heating means (14, 15) are disposed facing one another, on either side of two main faces of the endless strip.

16. The press of claim 10, further including means for removal and cleaning of the hardened material.

17. The press of claim 10, further including heating means for removing material (1) by melting of the material, and means (19) for cleaning the remelted material.

18. The press of claim 10, characterized in that the hardenable material (1) is polymerizable by exposure to radiation, and the means for hardening the hardenable material (1) include a radiation source (14) able to emit such radiation in the direction of the entire width and a small portion of the length of the strip.

19. The press of claim 18, wherein the hardened material (1) can be removed by chemical attack, and further including means enabling a chemical agent to be projected onto the hardened material, and means (19) for cleaning remelted material from the endless strip.

20. The press of claim 19, characterized in that the cleaning means (19) are physically disposed on the one hand so that the remelting or chemical attack of the material (1) will be started before the material comes into contact with the cleaning means, in order to facilitate cleaning of the material from the endless strip, and on the other hand so that the cleaning of the material from the endless strip will be facilitated by natural gravity.

21. The press of claim 10, wherein the hardenable material is magnetic and wherein the press includes means (21) for transfer of the hardenable magnetic material (1) between a reservoir (210) and predetermined locations of the metallic strip.

22. The press of claim 21, wherein the means for transfer includes, toward a face of the strip onto which the material is to be deposited and in proximity therewith, an outlet opening of material (1) from the reservoir (210), and facing the opening toward an opposite face, a set (211) of magnetic heads, for selectively magnetizing the predetermined locations of the endless strip and attracting material to said predetermined locations.

23. The press of claim 22, wherein the set (211) of magnetic heads includes means for displacing said magnetic heads relative to the endless strip in order to compensate for spacing between the magnetic heads and to enable motifs to be made on the endless strip.

24. The press of claim 10 further including means for polychrome printing of documents, said means for polychrome printing including:

in proximity with the endless strip, a number (m) of stations (17A, 17B, 17C, 17D) for applying each electrostatic colorant vehicle to the material (1) after being hardened, the number (m) being equivalent to the number of basic colors required for the printing, each station containing a different base color;

a developed length of endless strip equal at least to an entire number of times the length of a largest document is capable of being printed by the press;

slaving and control means arranged so that only one of the colorant vehicle application stations (17A, 17B, 17C, 17D) will be active at any given time.

25. The press of claim 24, wherein said press includes means (25, 26, 27) for pressing the printing carrier (3) against the endless strip, said means for pressing including a sheet feeding device (25), a sheet carrying cylinder (26) in contact while in rotation with the endless strip (2), and a device for collecting printed sheets, and further wherein said slaving and control means are arranged so that the sheet carrying cylinder (26) executes sufficient rotations in order to completely print one sheet.

26. A press, as set forth in claim 10, including means for continuous polychrome printing of documents with n basic colors wherein said means for continuous polychrome printing includes n presses, each having a single colorant vehicle application station (17), each station containing a different basic color and being arranged so that the printing carrier moves successively past each of said n presses.

* * * * *